US010765590B2

(12) United States Patent
Lee

(10) Patent No.: US 10,765,590 B2
(45) Date of Patent: Sep. 8, 2020

(54) FOAM GENERATOR FOR INVERTED COMPRESSION RECEPTACLES

(71) Applicant: APOLLO INDUSTRIAL CO., LTD., Siheung-si, Gyeonggi-do (KR)

(72) Inventor: Jae Kyung Lee, Seoul (KR)

(73) Assignee: APOLLO INDUSTRIAL CO., LTD., Siheung-si, Gyeonggi-do (KR)

( * ) Notice: Subject to any disclaimer, the term of this patent is extended or adjusted under 35 U.S.C. 154(b) by 418 days.

(21) Appl. No.: 15/746,924

(22) PCT Filed: Oct. 4, 2016

(86) PCT No.: PCT/KR2016/011077
§ 371 (c)(1),
(2) Date: Jan. 23, 2018

(87) PCT Pub. No.: WO2017/065439
PCT Pub. Date: Apr. 20, 2017

(65) Prior Publication Data

US 2020/0085669 A1 Mar. 19, 2020

(30) Foreign Application Priority Data

Oct. 13, 2015 (KR) ..... 10-2015-0142549

(51) Int. Cl.
*A61H 7/00* (2006.01)
*A47K 5/14* (2006.01)
(Continued)

(52) U.S. Cl.
CPC ..... *A61H 7/003* (2013.01); *A47K 5/14* (2013.01); *B01F 3/04992* (2013.01);
(Continued)

(58) Field of Classification Search
CPC .... A61H 7/003; A61H 2201/105; A61H 7/00; A61H 7/02; A61H 7/004; A61H 7/005;
(Continued)

(56) References Cited

U.S. PATENT DOCUMENTS 3,345,673 A * 10/1967 Schwartzman ..... A47L 23/05 401/183
4,531,659 A * 7/1985 Wright ..... A45D 27/10 222/190
(Continued)

FOREIGN PATENT DOCUMENTS

JP 2014-046943 A 3/2014
JP 2014-105030 A 6/2014
(Continued)

*Primary Examiner* — Justine R Yu
*Assistant Examiner* — Mayisha M Khan
(74) *Attorney, Agent, or Firm* — Novick, Kim & Lee, PLLC; Jae Youn Kim

(57) ABSTRACT

A foam generator is configured such that liquid contents pumped by an internal pressure as a result of directly compressing an inverted compression receptacle, having the liquid contents stored therein, are mixed with air in a gas-liquid mixing chamber and, at the same time, directly discharged in the form of foam. That is, direct compression of the inverted compression receptacle allows the liquid contents to be instantly discharged in the form of foam, thereby further improving product responsiveness.

4 Claims, 9 Drawing Sheets

(51) Int. Cl.

| | |
|---|---|
| ***B01F 3/04*** | (2006.01) |
| ***B01F 5/06*** | (2006.01) |
| ***B01F 15/02*** | (2006.01) |
| ***B05B 11/00*** | (2006.01) |

(52) U.S. Cl.
CPC ..... *B01F 5/0693* (2013.01); *B01F 15/026* (2013.01); *B01F 15/029* (2013.01); *B01F 15/0256* (2013.01); *B05B 11/3087* (2013.01); *A61H 2201/105* (2013.01); *B01F 2003/04872* (2013.01)

(58) Field of Classification Search
CPC ..... A61H 15/02; A61H 2201/0153; A61H 2201/0157; A61H 2201/169; A61H 2201/1692; A61H 2201/1695; B01F 15/029; B01F 15/026; B01F 15/0256; B01F 5/0693; B01F 3/04992; B01F 2003/04872; A47K 5/14; A47K 7/02; B65D 85/73; B65D 51/24; B65D 51/16; B65D 47/32; B65D 47/20; B65D 47/00; B65D 47/2018; B65D 47/061; B65D 47/242; B65D 47/244; B65D 47/263; B65D 47/283; B05B 7/0018; B05B 11/3087; B05B 11/04; B05B 11/042; B05B 7/0037; A45D 27/02; A45D 27/04
See application file for complete search history.

(56) References Cited

U.S. PATENT DOCUMENTS

| | | | | |
|---|---|---|---|---|
| 6,082,586 | A * | 7/2000 | Banks | A47K 5/14 222/95 |
| 9,566,595 | B2 * | 2/2017 | Tepas | B05B 11/043 |
| 2002/0153389 | A1 * | 10/2002 | Creaghan | B05B 11/043 222/190 |
| 2009/0001100 | A1 * | 1/2009 | van der Heijden | A47K 5/122 222/190 |
| 2012/0228332 | A1 * | 9/2012 | Huang | B05B 7/0037 222/190 |
| 2014/0061247 | A1 * | 3/2014 | Arminak | B05B 7/005 222/190 |
| 2014/0096786 | A1 * | 4/2014 | Nuzzo | A45D 7/00 132/207 |
| 2014/0110434 | A1 * | 4/2014 | Ciavarella | B05B 11/3087 222/133 |
| 2015/0173568 | A1 * | 6/2015 | Harris | B05B 11/00442 222/190 |
| 2016/0029855 | A1 * | 2/2016 | Harris | A47K 5/14 222/135 |
| 2018/0326434 | A1 * | 11/2018 | Aoyama | B05B 11/306 |

FOREIGN PATENT DOCUMENTS

| | | | |
|---|---|---|---|
| KR | 20-0169773 | Y1 | 2/2000 |
| KR | 10-2010-0137407 | A | 12/2010 |
| KR | 10-2011-0039000 | A | 4/2011 |
| KR | 10-1517825 | B1 | 5/2015 |

* cited by examiner

FOAM GENERATOR FOR INVERTED COMPRESSION RECEPTACLES

TECHNICAL FIELD

The present invention relates to a foam generator for inverted compression receptacles, and more particularly to a foam generator for inverted compression receptacles that mixes liquid contents with air and discharges the mixture in the form of foam when an inverted compression receptacle is directly compressed.

BACKGROUND ART

In general, a foam generator mixes liquid contents stored in a receptacle with air in an air and liquid mixing chamber and then forms and discharges uniform foam liquid through a filtration net. Such a foam generator is used for various purposes, such as shampoos, hair cosmetics, or cleansers used in bathrooms, kitchens, and restrooms.

A conventional foam generator is used to mix liquid contents with an appropriate amount of air and to extrude the mixture in the form of foam. In products to which such a foam generator is applied, a receptacle must be filled with compressed gas, making it technically difficult to manufacture the receptacle. The receptacle must be shaken whenever the receptacle is used. Also, in the state in which the product receptacle is inclined, the liquid filling the receptacle cannot be ejected in the form of foam, and only the compressed gas is ejected.

In order to solve the above problem, a foaming pump assembly that appropriately mixes liquid contents with external air and ejects the mixture in the form of foam without filling the foaming pump assembly with compressed air or without shaking the foaming pump assembly is disclosed in Korean Registered Utility Model No. 20-0169773 (Title of the Device: Air valve device of foam generator).

As shown in FIG. 1, the foaming pump assembly disclosed in Korean Registered Utility Model No. 20-0169773 includes a cap 1 coupled to the neck of a receptacle A having (liquid) contents stored therein in a screw coupling manner, a cylinder body 2 fixed in the cap 1, the cylinder body 2 having an air cylinder 2*a* having a negative pressure hole 2*b* formed therein and a long cylindrical liquid cylinder 2*c* integrally formed at the center of the lower part of the air cylinder 2*a* such that the (liquid) contents are introduced into the liquid cylinder 2*c*, a nozzle 3 installed to the cap 1 so as to be supported by the cap 1 such that one end thereof can be movable into the cylinder body 2, the nozzle 3 having an outlet 3*a*, through which foam is ejected, an air piston 4 having an upper part fixed to the inner circumference of the nozzle 3 and the outer circumference of a lower end disposed in tight contact with the inner circumference of the air cylinder 2*a* such that the air piston 4 presses the lower part of the air cylinder 2*a* and expands the upper part of the air cylinder 2*a* when the nozzle 3 is pushed, a liquid piston 6 disposed between a coil spring 5 provided at the lower part of the liquid cylinder 2*c* of the cylinder body 2 and the air piston 4 for elastically supporting the nozzle 3 upward and guiding the compressed air and the contents to the upper part of the air piston 4, and a ball 8 located at the bottom part of the liquid cylinder 2*c* of the cylinder body 2 for selectively opening and closing a liquid suction port 7. A filtration net 9 for filtering foam is disposed in the nozzle 3.

In the conventional foaming pump assembly, when the nozzle 3 is repeatedly pushed, the (liquid) contents filling the receptacle A are suctioned/pumped through the liquid cylinder 2*c*. At the same time, air is ejected from the air cylinder 2*a*. As a result, foam is generated. The foam is uniformly filtered through the filtration net 9 and is then ejected to the outside through the outlet 3*a* in the nozzle 3.

In the conventional foaming pump assembly, however, not only the structure for compressing and discharging air but also the structure for mixing suctioned liquid contents with the air and discharging the mixture in the form of foam are more complicated than necessary, whereby assembly productivity is lowered and costs are also increased. In addition, it is necessary for a user to receive foam discharged through the outlet 3*a* in the nozzle 3 with one hand while repeatedly pushing the nozzle 3 with another hand, which is inconvenient.

DISCLOSURE

Technical Problem

The present invention has been made in view of the above problems, and it is an object of the present invention to provide a foam generator for inverted compression receptacles simply configured such that liquid contents in a compression receptacle having the liquid contents stored therein are mixed with air and the mixture is discharged in the form of foam by the pressure generated in the compression receptacle when the compression receptacle is compressed, wherein an inverted compression receptacle is used as the compression receptacle such that foam can be directly ejected to a target, thereby achieving convenient use thereof using one hand.

It is another object of the present invention to provide a foam generator for inverted compression receptacles having a discharge blocking function, whereby it is possible to more stably use the product and to prevent the leakage of liquid from the product during the distribution of the product.

It is a further object of the present invention to provide a foam generator for inverted compression receptacles including a massage member such that a user can directly and uniformly apply the ejected foam to his/her skin without using the palms of his/her hands.

Technical Solution

In order to accomplish the above objects, the present invention provides a foam generator for inverted compression receptacles including: an inverted compression receptacle having liquid contents stored therein, the inverted compression receptacle being provided at the lower part thereof with a neck having screw threads formed therein; a cap main body including a large cap part fastened to the neck of the inverted compression receptacle in a screw coupling manner, an upward and downward movement guide wall disposed at the outside of the large cap part, the upward and downward movement guide wall being formed in the shape of a cylinder, and a foam discharge part protruding from the lower part of the large cap part in the shape of a pipe having a reduced diameter while a step is formed at the upper end thereof, the lower part of the foam discharge part being open, an air hole for allowing external air to be introduced therethrough being formed in the step; a content discharge guide configured such that the edge thereof is fitted, received, and disposed in the lower side of the large cap part of the cap main body so as to be spaced apart from the upper part of the step of the cap main body, the content discharge guide including a discharge guide part having a liquid discharge port formed in the central region thereof so as to be recessed concavely and a cylindrical discharge channel protruding from the upper part of the center of the discharge guide part for guiding the discharge of the liquid contents, the discharge guide part being provided at the edge thereof with an air discharge port, through which air in the inverted compression receptacle can move to the lower side of the discharge guide part when the inverted compression receptacle is compressed, and with an air introduction port, through which external air is introduced into the inverted compression receptacle when the inverted compression receptacle is restored to the original state thereof; a valve housing including a cylindrical coupling part fitted and coupled into the upper part of the content discharge guide so as to cover the upper part of the content discharge guide such that an air compartment, which communicates with the air discharge port and the air introduction port, is defined in the cylindrical coupling part, the cylindrical coupling part being provided in the central region thereof with a content suction port, the cylindrical coupling part being coaxially fitted and coupled into the discharge channel defined in the content discharge guide, a content check valve, for selectively opening and closing the content suction port depending on whether the inverted compression receptacle is compressed, being received and disposed in the cylindrical coupling part, a tube fitting port protruding from the upper surface of the valve housing so as to communicate with the air compartment; an air tube, having a lower end fitted and coupled into the tube fitting port of the valve housing and an upper end extending toward the upper part of the inverted compression receptacle, for allowing the upper space in the inverted compression receptacle, in which air remains, and the air compartment to communicate with each other therethrough; an air check valve unit made of an elastic material, the air check valve unit including a ring-shaped partition wall, having an upper end disposed in tight contact with the lower surface of the content discharge guide and a lower end disposed in tight contact with the upper part of the step of the cap main body, for defining an air and liquid mixing chamber in the foam discharge part, a first check valve part disposed inside the partition wall so as to extend upward toward the central part thereof, an end of the first check valve part being disposed in elastically tight contact with the discharge guide part of the content discharge guide, the first check valve part being configured to allow the air in the inverted compression receptacle to move to the air and liquid mixing chamber through the air discharge port when the inverted compression receptacle is compressed, and a second check valve part disposed outside the partition wall so as to extend downward toward the outside, an end of the second check valve part being disposed in elastically tight contact with the outside of the step of the cap main body, the second check valve part being configured to close the air hole when the inverted compression receptacle is compressed and to open the air hole when the inverted compression receptacle is restored to the original state thereof such that external air can be introduced; a filtration member fitted, received, and disposed in the foam discharge part of the cap main body, the filtration member being formed in the shape of a cylinder having open upper and lower parts, the filtration member being provided at the upper and lower surfaces thereof with filtration nets, the filtration member being configured to guide the discharge of foam formed as the result of the liquid contents being mixed with air in the air and liquid mixing chamber while homogenizing the foam; and an upward and downward movement cap including a cylindrical wall surface having an upper end received in and coupled to the upward and downward movement guide wall of the cap main body so as to be movable upward and downward and a lower surface configured to cover the lower part of the cap main body, the lower surface being provided with a plurality of foam distribution holes, through which the foam that has passed through the filtration member is discharged to the outside in a distributed manner, the upward and downward movement cap being provided at the center of the lower surface thereof with a cylindrical blocking wall in a protruding manner for selectively opening and closing the foam discharge part according to the upward and downward manipulation thereof.

In addition, the content check valve may include: a valve body disposed in the coupling part of the valve housing so as to be slidable vertically for opening and closing the content suction port, the upper end of the valve body being formed in a conical shape; and an elastic member for elastically supporting the valve body upward in the coupling part of the valve housing.

In addition, the foam generator for inverted compression receptacles may further include a massage member, wherein the massage member may include: a base fitted and mounted in the lower part of the upward and downward movement cap, the base being provided therein with a plurality of communication ports, which communicate with the respective foam distribution holes; and massage bristles provided at the lower surface of the base for uniformly applying foam discharged through the communication ports to the skin of a user.

In addition, support shafts may be formed inside the upward and downward movement guide wall in a protruding manner such that the support shafts are opposite each other, and the upward and downward movement cap may be provided at the outside of the wall surface thereof with spiral grooves for receiving the support shafts, the spiral grooves being formed so as to be opposite each other over a predetermined region, the upward and downward movement cap being disposed so as to move upward or downward to the regular positions thereof by rotating the upward and downward movement cap in a forward direction or a reverse direction, whereby, when the upward and downward movement cap is moved maximally downward as the result of the rotation of the upward and downward movement cap in the forward direction, the cylindrical blocking wall may open the foam discharge part, and when the upward and downward movement cap is moved maximally upward as the result of the rotation of the upward and downward movement cap in the reverse direction, the cylindrical blocking wall may close the foam discharge part.

Advantageous Effects

In the foam generator for inverted compression receptacles according to the present invention having the above-stated structure, liquid contents, discharged out of the inverted compression receptacle having the liquid contents stored therein through the content check valve opened by the pressure generated in the inverted compression receptacle when the inverted compression receptacle is directly compressed, are mixed with air in the air and liquid mixing chamber, and the mixture is directly discharged in the form of foam. Consequently, the mechanical structure for instantly discharging the liquid contents in the form of foam when the inverted compression receptacle is compressed is configured so as to be simpler than the conventional art, and product responsiveness is improved. In particular, the inverted compression receptacle can be directly compressed by a user using one hand such that the contents are discharged in the form of foam, whereby it is possible to improve user convenience.

Also, in the foam generator for inverted compression receptacles according to the present invention, the user can apply the ejected foam to his/her skin or can cleanse his/her skin using the massage member. In particular, the user can directly and uniformly apply the ejected foam (the contents) to his/her skin using the massage member, akin to massaging the skin of the user without using the palms of the hands.

Furthermore, in the foam generator for inverted compression receptacles according to the present invention, the upward and downward movement cap can be moved upward and downward to easily open and close the foam discharge part by manipulating the upward and downward movement cap in the forward direction and the reverse direction, whereby it is possible to more stably use the product and to prevent the leakage of liquid from the product during the distribution of the product.

DESCRIPTION OF REFERENCE SYMBOLS

Figure 1:
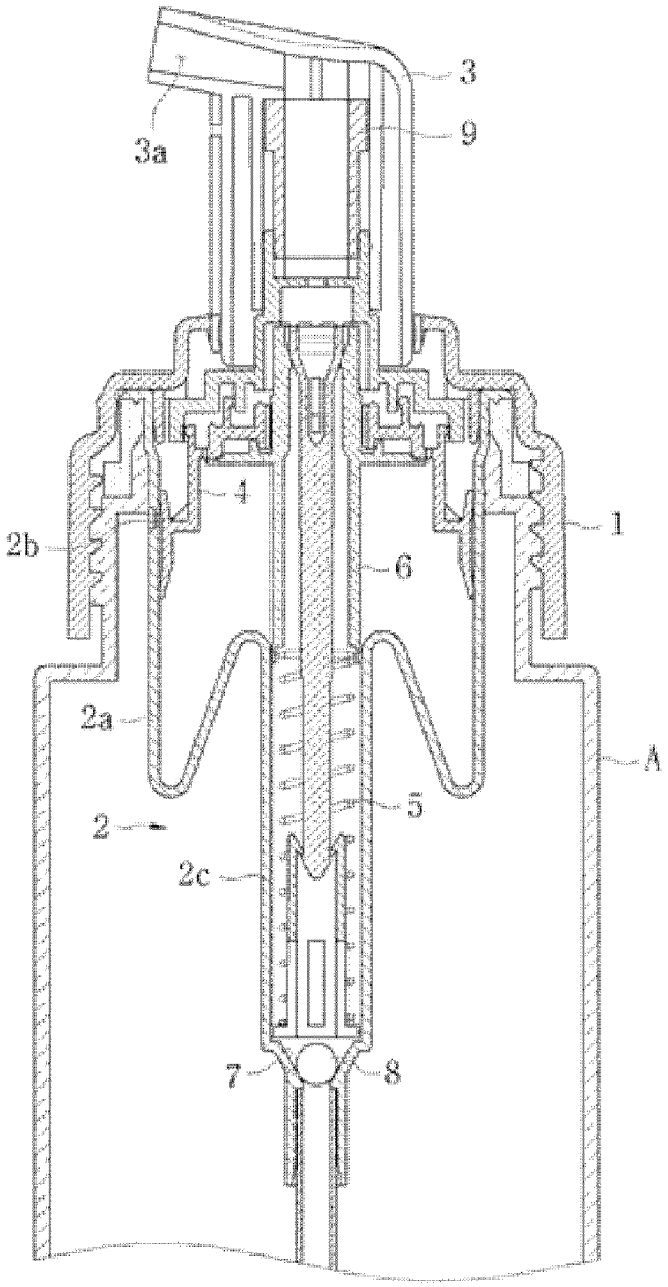
FIG. 1 PRIOR ART
FIG. 1 is a view showing an air valve device of a foam generator disclosed in Korean Registered Utility Model No. 20-0169773, which is a conventional art.

100 . . . Inverted compression receptacle 110 . . . Neck 200 . . . Cap main body

210 . . . Large cap part 220 . . . Upward and downward movement guide wall 230 . . . Step

240 . . . Foam discharge part 250: Air hole 260: Support shafts

300 . . . Content discharge guide 310 . . . Edge 320 . . . Discharge guide part

330 . . . Liquid discharge ports 340 . . . Discharge channel 350 . . . Air discharge ports

360 . . . Air introduction ports 400 . . . Valve housing 410 . . . Air compartment

420 . . . Content suction port 430 . . . Content check valve 431 . . . Valve body

432 . . . Elastic member 440 . . . Coupling part 450 . . . Tube fitting port

500 . . . Air tube 600 . . . Air check valve unit 610 . . . Partition wall

620 . . . First check valve part 630 . . . Second check valve part 700 . . . Filtration member

710 . . . Body 720, 730 . . . Filtration nets 800 . . . Upward and downward movement cap

810 . . . Wall surface 820 . . . Lower surface 830 . . . Filtration distribution holes

840 . . . Cylindrical blocking wall 850 . . . Spiral grooves 900 . . . Massage member

910 . . . Base 920 . . . Communication ports 930 . . . Massage bristles S . . . Air and liquid mixing chamber

BEST MODE

Figure 7:
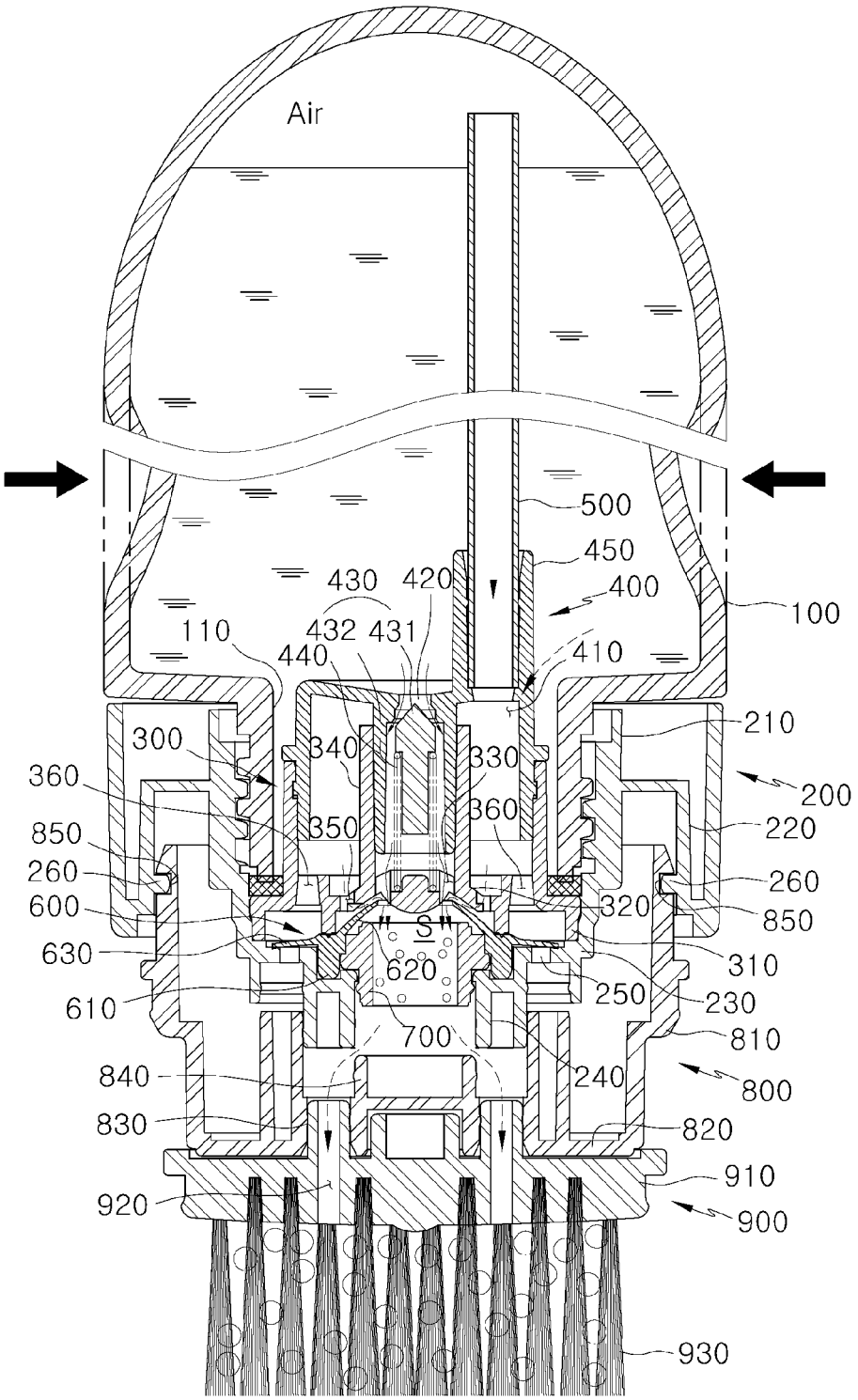
FIG. 7 is a view showing a foam ejection process of the foam generator for inverted compression receptacles according to the present invention.
Figure 8:
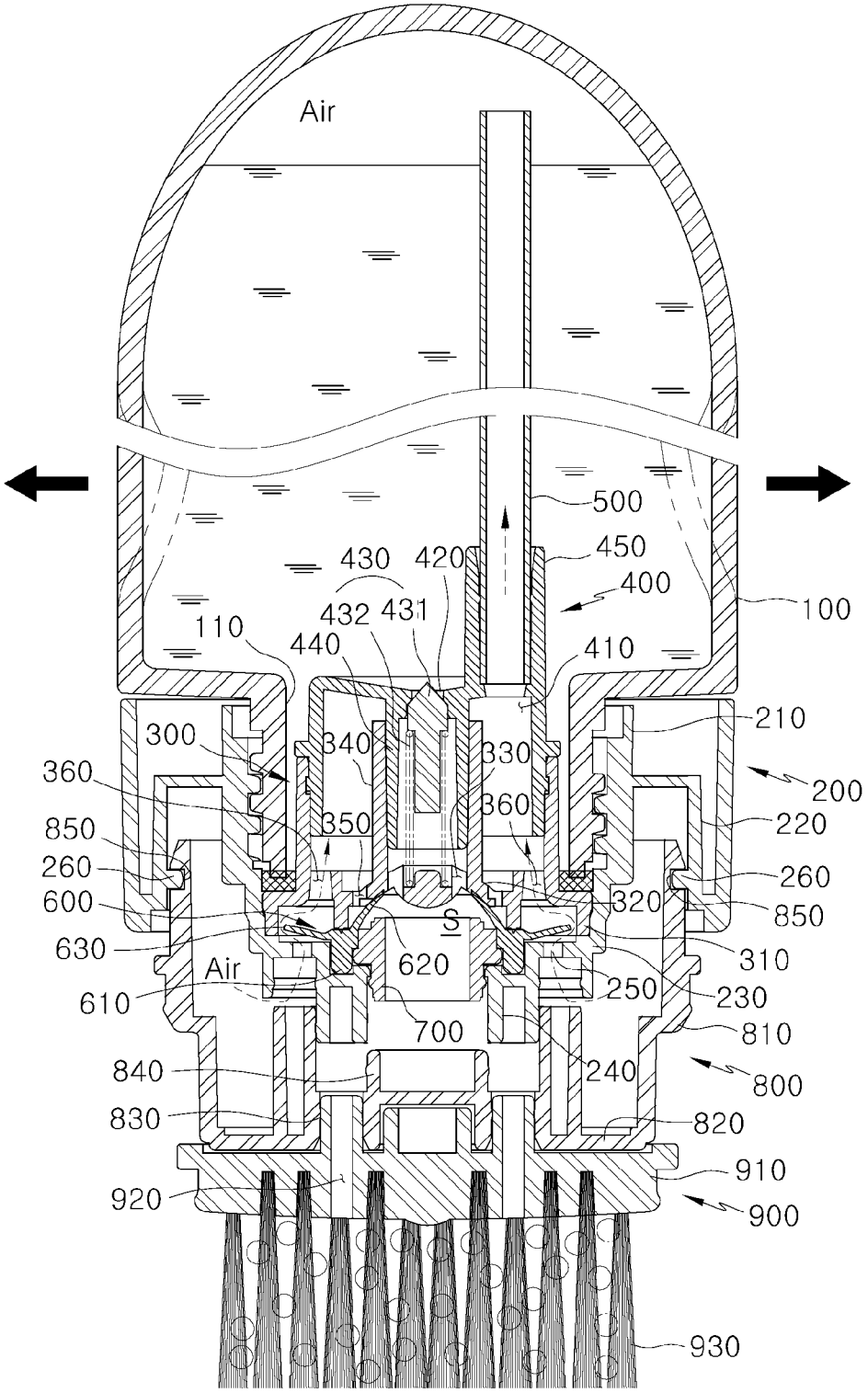
FIG. 8 is a view showing a restoration process (an external air suction process) of the foam generator for inverted compression receptacles according to the present invention.
Figure 9:
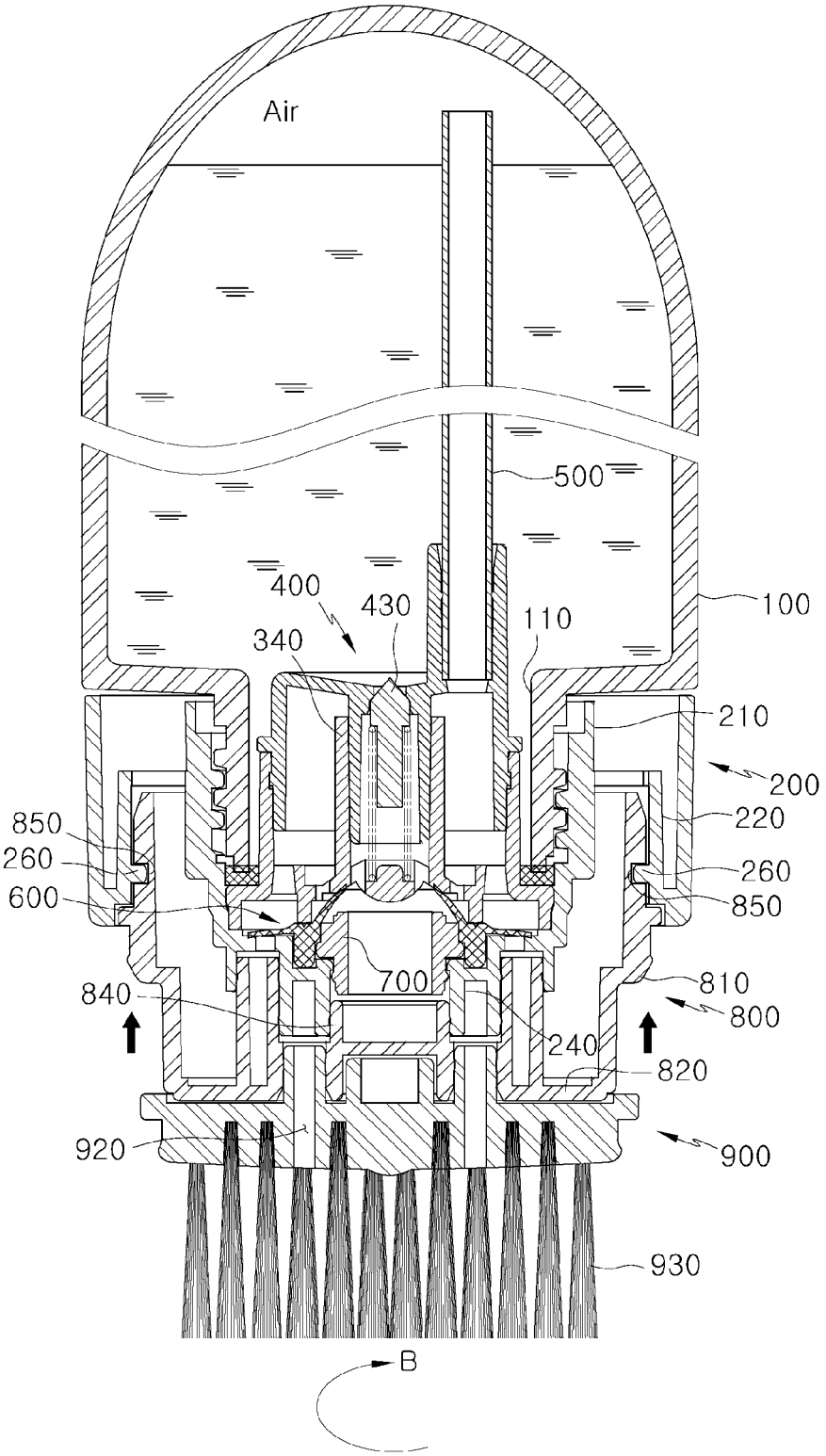
FIG. 9 is a view showing the state in which the foam generator for inverted compression receptacles according to the present invention has been locked using an upward and downward movement cap.

Hereinafter, a preferred embodiment of the present invention will be described in detail with reference to the accompanying drawings. Briefly describing the accompanying drawings, FIGS. 2 to 6 show the structure of a foam generator for inverted compression receptacles according to the present invention, and FIGS. 7 to 9 show the state in which the foam generator for inverted compression receptacles according to the present invention is used.

Figure 2:
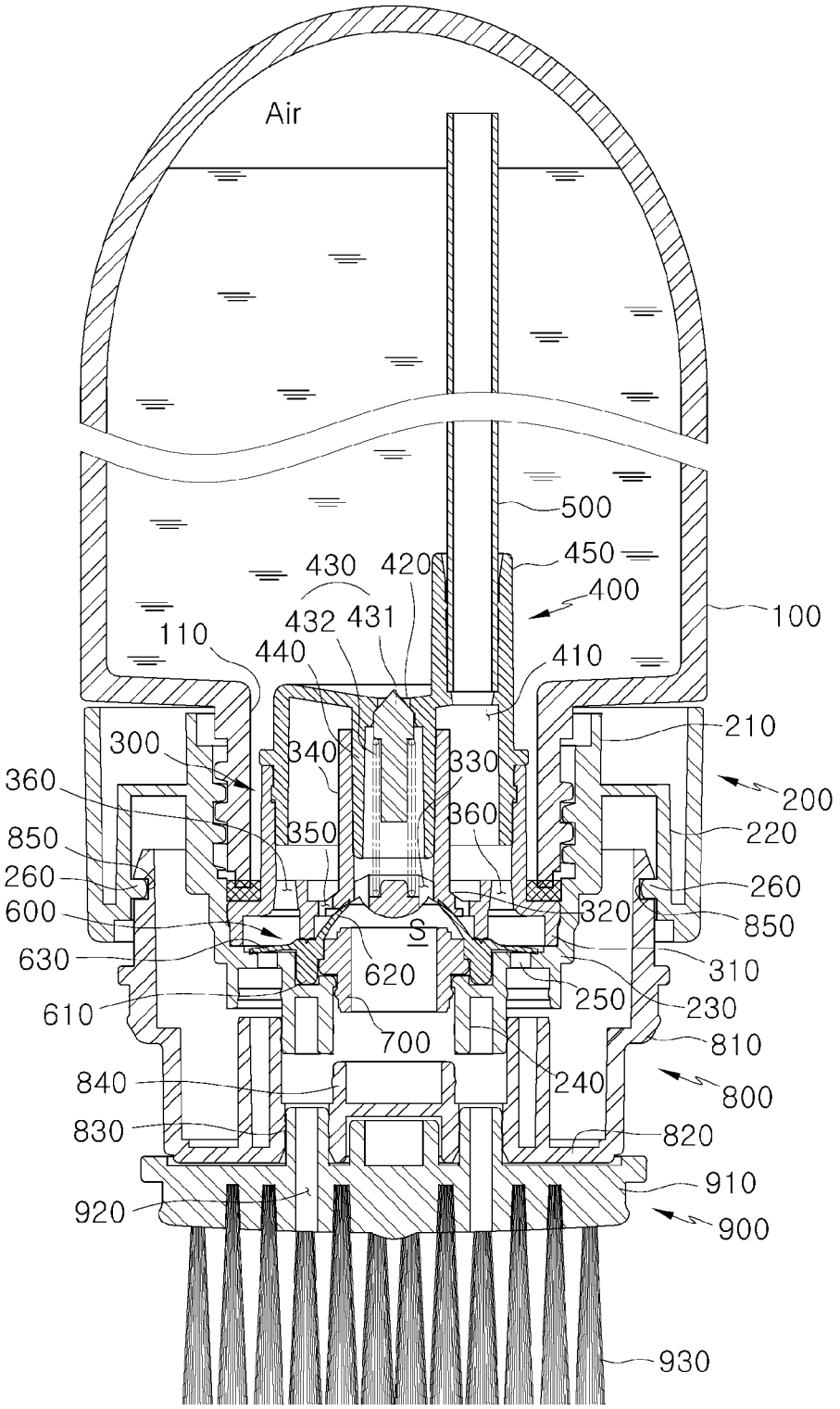
FIG. 2 is a sectional view showing the overall interior structure of a foam generator for inverted compression receptacles according to the present invention.
Figure 3:
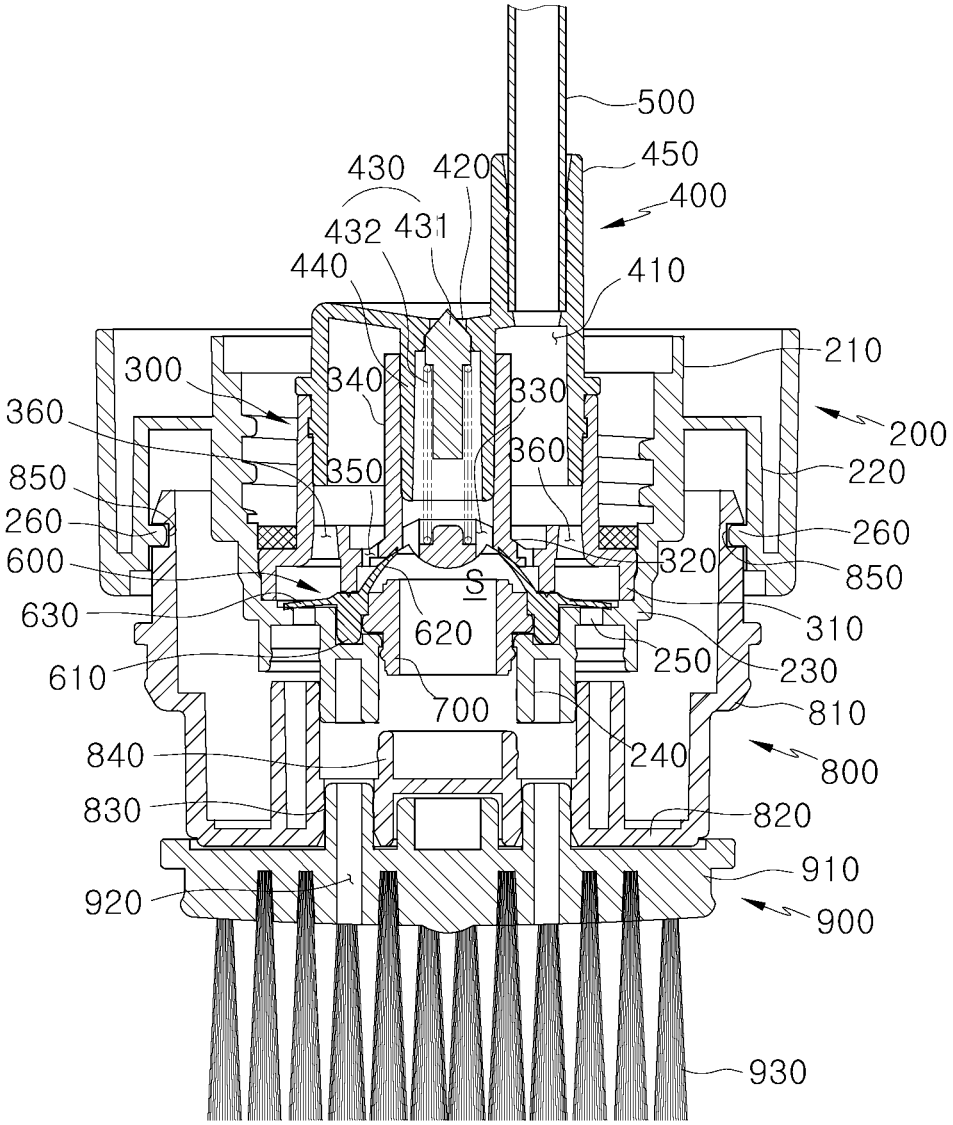
FIG. 3 is an extracted enlarged sectional view showing the interior structure of the foam generator for inverted compression receptacles according to the present invention, from which an inverted compression receptacle has been removed.

Description of Structure of Foam Generator for Inverted Compression Receptacles According to the Present Invention The foam generator for inverted compression receptacles according to the present invention is mounted to a neck of an inverted compression receptacle having contents stored therein such that liquid contents are discharged out of the inverted compression receptacle in the form of foam while the liquid contents are mixed with air using the pressure generated in the inverted compression receptacle when the inverted compression receptacle is directly compressed. As shown in FIGS. 2 and 3, the foam generator for inverted compression receptacles includes an inverted compression receptacle 100 having liquid contents stored therein, the inverted compression receptacle 100 being configured to be restored to the original state thereof due to the elastic force thereof, a cap main body 200 coupled to a neck 110 of the inverted compression receptacle 100, a content discharge guide 300 received and disposed in the cap main body 200 for guiding the discharge of the liquid contents and air when the inverted compression receptacle 100 is compressed, a valve housing 400 coupled to the upper part of the content discharge guide 300, a content check valve 430 for controlling the discharge of the liquid contents being mounted in the valve housing 400, an air check valve unit 600 for controlling the suction and discharge of air according to the compression and restoration operation of the inverted compression receptacle 100, a filtration member 700 received and disposed in the cap main body 200 for homogenizing foam formed as the result of the liquid contents being mixed with air, an upward and downward movement cap 800 assembled to the lower part of the cap main body 200 so as to be movable upward and downward for ejecting the foam to the outside, and a massage member 900 mounted to the lower part of the upward and downward movement cap 800.

The detailed structures of the respective components constituting the foam generator for inverted compression receptacles according to the present invention are as follows.

First, the inverted compression receptacle 100 has liquid contents stored therein. As shown in FIG. 2, the inverted compression receptacle 100 is made of soft synthetic resin, which can be compressed by a user using his/her hand and which can be restored to the original state thereof when the compression force is removed. Screw threads are formed in the outer wall of the neck 110 of the inverted compression receptacle 100, which is used in the inverted state. The neck 110 is formed at the lower part of the inverted compression receptacle 100 based on the state in which the inverted compression receptacle 100 is used.

Figure 4:
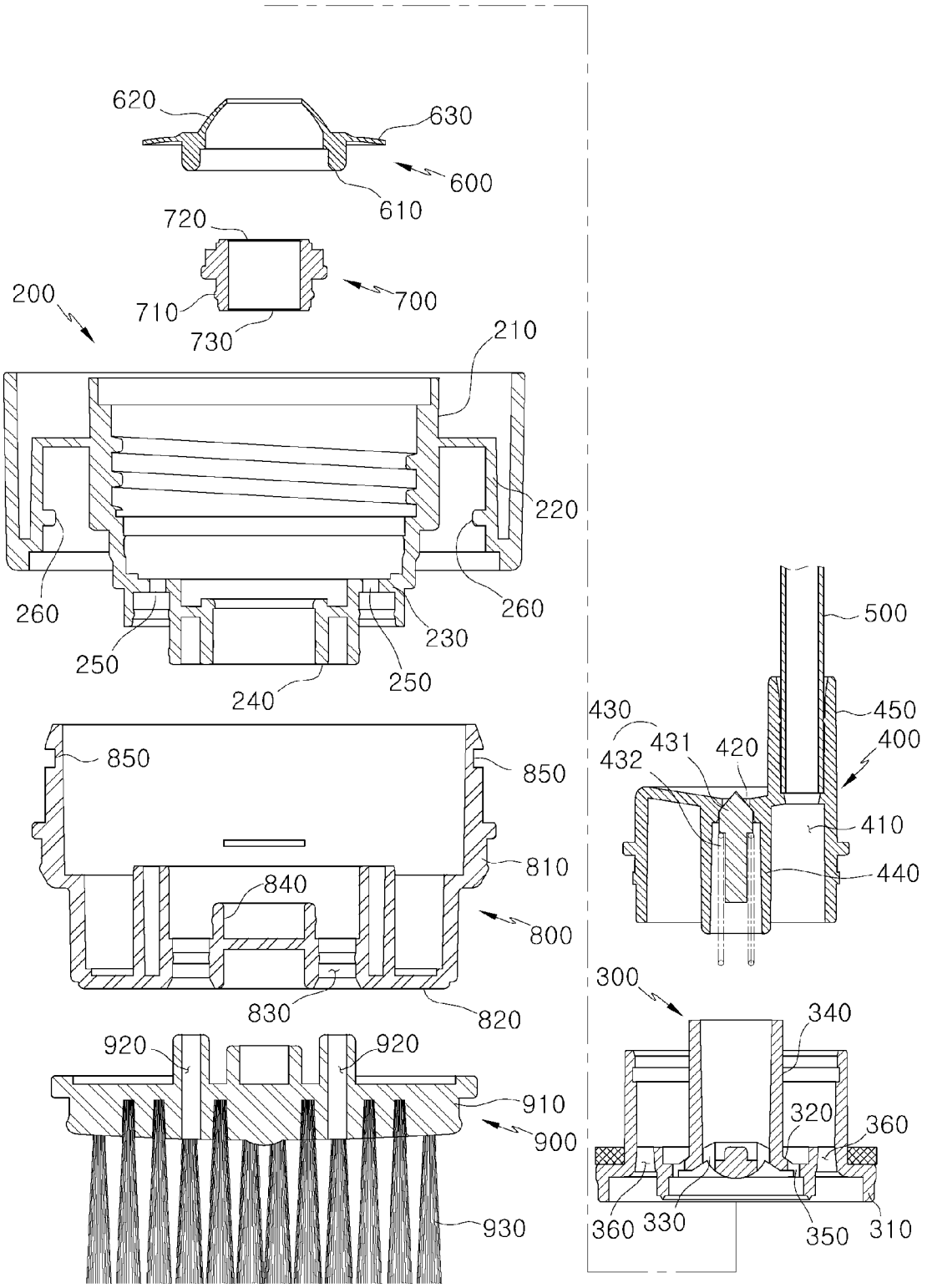
FIG. 4 is an exploded sectional view of the foam generator for inverted compression receptacles according to the present invention.
Figure 5:
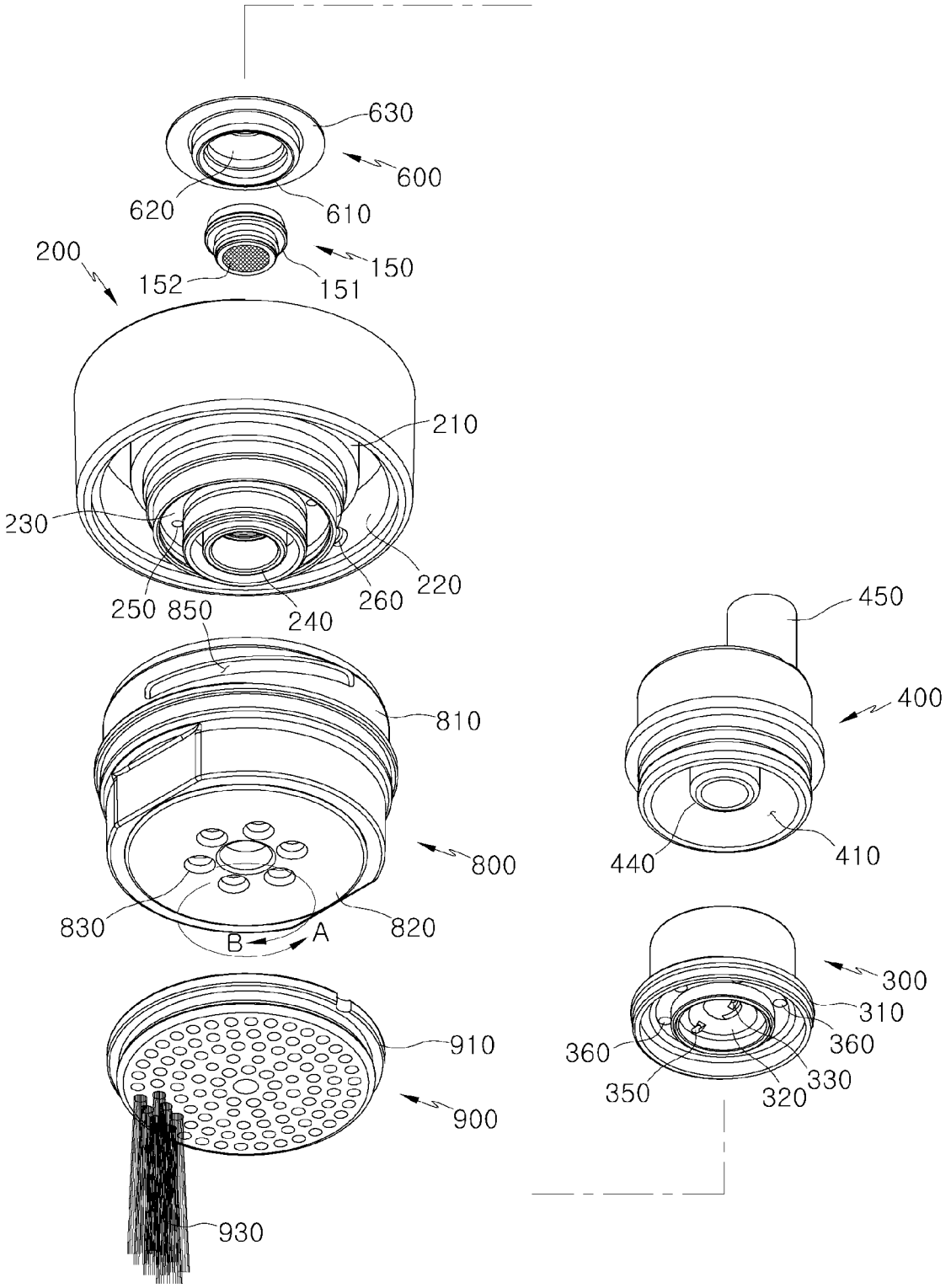
FIG. 5 is an exploded perspective view of the foam generator for inverted compression receptacles according to the present invention.
Figure 6:
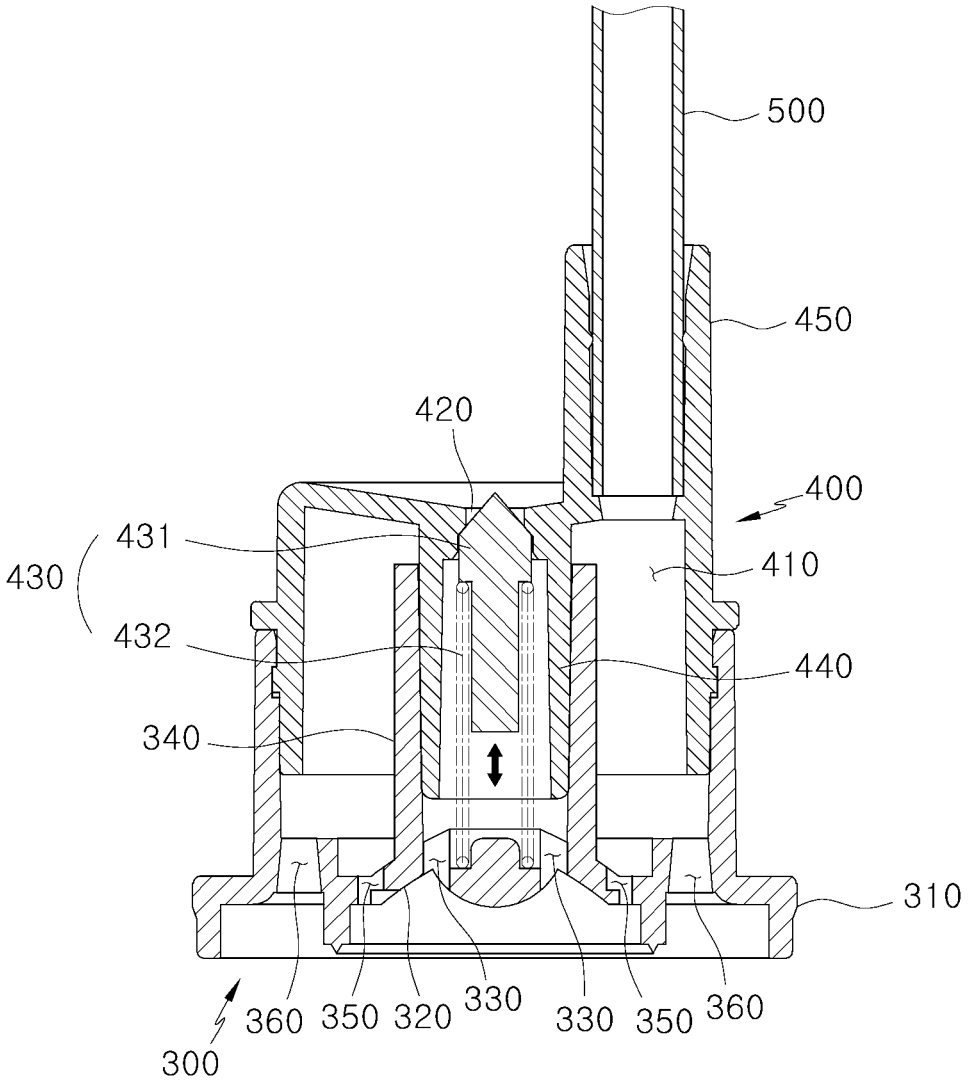
FIG. 6 is an extracted sectional view showing the coupling structure of a valve housing according to the present invention.

The cap main body 200 is made of hard synthetic resin. As shown in FIGS. 3 to 5, the cap main body 200 includes a large cap part 210 fastened to the neck 110 of the inverted compression receptacle 100 in a screw coupling manner and a foam discharge part 240 protruding from the lower part of the large cap part 210 in the shape of a pipe having a reduced diameter while a step 230 is formed at the upper end thereof, the lower part of the foam discharge part 240 being open. In addition, an air hole 250 for allowing external air to be introduced therethrough is formed in the step 230 of the cap main body 200. The air hole 250 is configured to allow the external air to be introduced into the inverted compression receptacle 100 therethrough when the inverted compression receptacle 100 is elastically restored to the original state thereof. In addition, an upward and downward movement guide wall 220, which is formed in the shape of a cylinder, is integrally formed at the outside of the large cap part 210. The upward and downward movement guide wall 220 is configured to guide the upward and downward movement of the upward and downward movement cap 800. Support shafts 260 are formed inside the upward and downward movement guide wall 220 in a protruding manner such that the support shafts 260 are opposite each other.

The content discharge guide 300 is also made of hard synthetic resin. As shown in FIGS. 3 to 5, an edge 310 of the content discharge guide 300 is fitted, received, and disposed in the lower end of the large cap part 210 of the cap main body 200 so as to be spaced apart from the upper part of the step 230 of the cap main body 200 by a predetermined distance such that a space is defined therebetween. The content discharge guide 300 includes a discharge guide part 320 having a liquid discharge port 330 formed in the center thereof so as to be recessed concavely and a cylindrical discharge channel 340 protruding from the upper part of the center of the discharge guide part 320 for guiding the discharge of the liquid contents. In addition, the discharge guide part 320 is provided at the outside thereof with an air discharge port 350, through which the air in the inverted compression receptacle 100 can move to the lower side of the discharge guide part 320 when the inverted compression receptacle 100 is compressed, and with an air introduction port 360, through which external air that has been introduced through the air hole 250 can be introduced into the inverted compression receptacle 100 when the inverted compression receptacle 100 is restored to the original state thereof. In this embodiment of the present invention, six air introduction ports 360 are formed in the outside of the discharge guide part 320 such that the inverted compression receptacle 100 can be instantly restored to the original state thereof, and two air discharge ports 350 are formed so as to be opposite each other, i.e. to be offset at an angle of 180 degrees, such that air can rapidly move to an air and liquid mixing chamber S, a description of which will follow, when the inverted compression receptacle 100 is compressed. In addition, the liquid discharge port 330 of the discharge guide part 320 is formed so as to branch into a plurality of liquid discharge ports at the center of the discharge guide part 320 in the radial direction thereof such that the liquid contents discharged upward through the discharge tube 130 are distributed and smoothly mixed with air in the air and liquid mixing chamber S (in this embodiment of the present invention, the liquid discharge port 330 branches into two liquid discharge ports that are opposite each other, i.e. are offset at an angle of 180 degrees).

As shown in FIGS. 3 to 6, the valve housing 400 includes a cylindrical coupling part 440 fitted and coupled into the upper part of the content discharge guide 300 so as to cover the upper part of the content discharge guide 300 such that an air compartment 410, which communicates with the air discharge ports 350 and the air introduction ports 360, is defined in the cylindrical coupling part 440. The cylindrical coupling part 440 is provided in the central region thereof with a content suction port 420. The cylindrical coupling part 440 is coaxially fitted and coupled into the discharge channel 340 defined in the content discharge guide 300. The content check valve 430, which selectively opens and closes the content suction port 420 depending on whether the inverted compression receptacle 100 is compressed, is received and disposed in the coupling part 440 of the valve housing 400. The content check valve 430 includes a valve body 431 disposed in the coupling part 440 of the valve housing 400 so as to be slidable vertically for opening and closing the content suction port 420, the upper end of the valve body 431 being formed in a conical shape, and an elastic member 432 (a coil spring in the embodiment of the present invention) for elastically supporting the valve body 431 upward in the coupling part 440. When the inverted compression receptacle 100 is compressed, therefore, the pressure in the inverted compression receptacle 100 pushes the valve body 431 downward against the elastic supporting force of the elastic member 432. As a result, the liquid contents move to the discharge guide part 320 of the content discharge guide 300. In addition, a tube fitting port 450 protrudes from the upper surface of the valve housing 400 so as to communicate with the air compartment 410. An air tube 500 is fitted and coupled into the tube fitting port 450. That is, the lower end of the air tube 500 is fitted and coupled into the tube fitting port 450, and the upper end of the air tube 500 extends toward the upper part of the inverted compression receptacle 100. Consequently, the upper space in the inverted compression receptacle 100, in which air remains, and the air compartment 410 communicate with each other through the air tube 500.

The air check valve unit 600 is made of an elastic rubber material (silicone or NBR). As shown in FIGS. 3 to 5, the air check valve unit 600 includes a ring-shaped partition wall 610, having an upper end disposed in tight contact with the lower surface of the bottom of the content discharge guide 300 and a lower end disposed in tight contact with the upper part of the step 230 of the cap main body 200, for defining the air and liquid mixing chamber S in the foam discharge part 240, a first check valve part 620 disposed inside the partition wall 610 so as to extend upward toward the central part thereof, an end of the first check valve part 620 being disposed in elastically tight contact with the discharge guide part 320 of the content discharge guide 300, the first check valve part 620 being configured to allow the air discharged from the inverted compression receptacle 100 through the air discharge ports 350 to move to the air and liquid mixing chamber S when the inverted compression receptacle 100 is compressed, and a second check valve part 630 disposed outside the partition wall 610 so as to extend downward toward the outside, an end of the second check valve part 630 being disposed in elastically tight contact with the outside of the step 230 of the cap main body 200, the second check valve part 630 being configured to close the air hole 250 when the inverted compression receptacle 100 is compressed and to open the air hole 250 when the inverted compression receptacle 100 is restored to the original state thereof such that air can be introduced through the air hole 250.

As shown in FIGS. 3 to 5, the filtration member 700 includes a cylindrical body 710 fitted, received, and disposed in the foam discharge part 240 (the air and liquid mixing chamber S) of the cap main body 200, the upper and lower parts of the cylindrical body 710 being open, and mesh-shaped filtration nets 720 and 730 provided to cover the upper and lower surfaces of the body 710. Consequently, the filtration member 700 guides the downward discharge of foam formed as the result of the liquid contents being mixed with air in the air and liquid mixing chamber S while homogenizing the foam.

The upward and downward movement cap 800 is configured to guide the discharge of the foam in the foam generator for inverted compression receptacles according to the present invention to the outside and to lock the foam generator for inverted compression receptacles according to the present invention. As shown in FIGS. 3 to 5, the upward and downward movement cap 800 includes a cylindrical wall surface 810 having an upper end received in and coupled to the upward and downward movement guide wall 220 of the cap main body 200 so as to be movable upward and downward and a lower surface 820 configured to cover the lower part of the cap main body 200, the lower surface 820 being provided with a plurality of foam distribution holes 830, through which the foam that has passed through the filtration member 700 is discharged to the outside in a distributed manner. In addition, the upward and downward movement cap 800 is provided at the center of the lower surface 820 thereof with a cylindrical blocking wall 840 for selectively opening and closing the foam discharge part 240 according to the upward and downward manipulation thereof so as to allow or prevent the communication between the foam discharge part 240 and the foam distribution holes 830.

The upward and downward movement of the upward and downward movement cap 800 is achieved by rotating the upward and downward movement cap 800 in the forward direction and the reverse direction. That is, the upward and downward movement cap 800 is provided at the outside of the wall surface 810 thereof with spiral grooves 850 inclined upward from the lower part thereof for receiving the support shafts 260. The spiral grooves 850 are formed so as to be opposite each other in a predetermined region (a 90-degree region in the present invention). Consequently, the upward and downward movement cap 800 is moved downward or upward to the regular positions thereof by rotating the upward and downward movement cap 800 in the forward direction or the reverse direction. When the upward and downward movement cap 800 is moved maximally downward as the result of the rotation of the upward and downward movement cap 800 in the forward direction (in the direction indicated by the arrow A in FIG. 5), therefore, the cylindrical blocking wall 840 becomes spaced apart from the upper part of the foam discharge part 240. As a result, the foam discharge part 240 communicates with the foam distribution holes 830, whereby the foam can be discharged. On the other hand, when the upward and downward movement cap 800 is moved maximally upward as the result of the rotation of the upward and downward movement cap 800 in the reverse direction (in the direction indicated by the arrow B in FIG. 5), the cylindrical blocking wall 840 completely closes the lower part of the foam discharge part 240. As a result, the foam is prevented from being discharged (see FIG. 9).

Meanwhile, as shown in FIGS. 3 to 5, the massage member 900 includes a base 910 fitted and mounted in the lower part of the upward and downward movement cap 800 so as to cover the lower part of the upward and downward movement cap 800, the base 910 being provided therein with a plurality of communication ports 920, which communicate with the respective foam distribution holes 830, and massage bristles 930 implanted over the entire lower surface of the base 910. The massage bristles 930 are configured to uniformly apply the foam discharged through the communication ports 920 to the skin of a user in the state of being in elastic contact with the skin of the user.

Description of Operation and Effects of Foam Generator for Inverted Compression Receptacles According to the Present Invention Next, the operation and effects of the foam generator for inverted compression receptacles according to the present invention will be described with reference to FIGS. 2 and 7 to 9.

First, as shown in FIG. 2, when the foam generator for inverted compression receptacles according to the present invention is in an initial state, the inverted compression receptacle 100 having the liquid contents and the air stored therein is maintained in the original state thereof, and the content check valve 430 keeps the content suction port 420 closed. In addition, the first check valve part 620 of the air check valve unit 600 is disposed in tight contact with the discharge guide part 320 of the content discharge guide 300 due to the elastic restoration force thereof, and the second check valve part 630 of the air check valve unit 600 is also disposed in tight contact with the outside of the step 230 of the cap main body 200 so as to keep the air hole 250 closed using the elastic restoration force thereof.

When a user presses the inverted compression receptacle 100 in order to compress the inverted compression receptacle 100 (see the direction indicated by the arrow in FIG. 7) in the state in which the upward and downward movement cap 800 has been moved downward, as shown in FIG. 7, pressure is generated in the inverted compression receptacle 100. As a result, the air and the liquid contents in the inverted compression receptacle 100 are compressed.

Consequently, some of the liquid contents stored in the inverted compression receptacle 100 move to the air and liquid mixing chamber S through the liquid discharge ports 330 as the result of opening of the content check valve 430 (see the direction indicated by the solid arrow in FIG. 7). In addition, some of the air in the inverted compression receptacle 100 is compressed, is introduced into the air compartment 410 of the valve housing 400 through the air tube 500, closes the second check valve part 630, opens the first check valve part 620, and then moves to the air and liquid mixing chamber S (see the direction indicated by the dashed arrow in FIG. 7).

In the air and liquid mixing chamber S, the compressed air and the liquid contents are mixed with each other to form foam. Since the liquid contents are discharged while being distributed through the liquid discharge ports 330, the liquid contents can be more smoothly mixed with the air to instantly form foam. The foam is homogenized while passing through the filtration member 700. The homogenized foam is discharged to the outside via the foam distribution holes 830 in the upward and downward movement cap 800 and the communication ports 920 in the massage member 900.

When the artificial force applied to the inverted compression receptacle 100 is removed, as shown in FIG. 8, the inverted compression receptacle 100 is restored to the original state thereof due to the elastic restoration force thereof, whereby negative pressure is generated in the inverted compression receptacle 100. That is, when negative pressure is generated in the inverted compression receptacle 100 as the result of restoration of the distorted compression receptacle 100 to the original state thereof, the second check valve part 630 of the air check valve unit 600 is instantaneously opened. As a result, external air is introduced into the air compartment 410 of the valve housing 400 through the air hole 250 and the air introduction ports 360. Subsequently, the air that has been introduced into the air compartment 410 is introduced into the inverted compression receptacle 100 through the air tube 500. That is, a volume of external air equal to that of the liquid contents that have been discharged from the inverted compression receptacle 100 is introduced into the inverted compression receptacle 100 through the air hole 250 and the air introduction ports 360, whereby the inverted compression receptacle 100 is maintained in the initial state thereof. During the restoration of the inverted compression receptacle 100, the first check valve part 620 of the air check valve unit 600 comes into tight contact with the discharge guide part 320 in order to close the air discharge ports 350.

This series of processes may be repeated in order to eject and use the liquid contents stored in the inverted compression receptacle 100 in the form of foam. That is, in the foam generator for inverted compression receptacles according to the present invention, the inverted compression receptacle 100 having the contents stored therein is directly compressed. As a result, the liquid contents are mixed with air due to the pressure in the inverted compression receptacle 100, and the mixture is directly discharged in the form of foam. In addition, even when the user directly compresses the inverted compression receptacle 100 using one hand, the contents are discharged to the outside in the form of foam, thereby improving user convenience. Furthermore, the user can uniformly apply the foam discharged to the outside to his/her skin or can cleanse his/her skin using the massage member 900 without using his/her hands. In particular, the user can uniformly apply the foam to his/her skin while pushing the massage bristles 930 of the massage member 900 onto his/her skin in the manner of massaging the skin of the user.

Meanwhile, when the upward and downward movement cap 800 is rotated by 90 degrees in the reverse direction (in the direction indicted by the arrow B in FIG. 9), as shown in FIG. 9, the upward and downward movement cap 800 is moved upward, whereby the cylindrical blocking wall 840 is received in the foam discharge part 240 while coming into tight contact with the foam discharge part 240 in order to close the foam discharge part 240. {Since the support shafts 260 are received in and coupled to the respective spiral grooves 850, as previously described, the upward and downward movement cap 800 is moved upward and downward only to the regular positions thereof by rotating the upward and downward movement cap 800 in the forward direction and the reverse direction.} In the state in which the upward and downward movement cap 800 has been moved upward to close the foam discharge part 240, as described above, foam (contents and air) can be completely prevented from being discharged even when the inverted compression receptacle 100 is pressed such that the inverted compression receptacle 100 is compressed, whereby the inverted compression receptacle 100 remains locked. That is, the discharge of foam is guided and the inverted compression receptacle 100 is locked through the upward and downward movement cap 800 fastened to the inverted compression receptacle 100 in a rotation and upward and downward movement manner, whereby it is possible to more stably use the product and to prevent the leakage of liquid from the product during the distribution of the product.

INDUSTRIAL APPLICABILITY

The present invention is widely applicable to the field of a foam generator for inverted compression receptacles that is capable of mixing contents with air and discharging the mixture in the form of foam when an inverted compression receptacle is directly compressed.

The invention claimed is:

1. A foam generator for inverted compression receptacles, the foam generator comprising:

an inverted compression receptacle having liquid contents stored therein, the inverted compression receptacle having a neck disposed at a lower part of the inverted compression receptacle, the neck having screw threads formed therein;

a cap main body comprising a large cap part fastened to the neck of the inverted compression receptacle in a screw coupling manner, an upward and downward movement guide wall disposed at an outside of the large cap part, the upward and downward movement guide wall being formed in a shape of a cylinder, a foam discharge part protruding from a lower part of the large cap part in a shape of a pipe having a reduced diameter, a step formed at an upper end of the foam discharge part, a lower part of the foam discharge part being open, and an air hole for allowing external air to be introduced therethrough being formed in the step;

a content discharge guide having an edge fitted in a lower side of the large cap part of the cap main body so as to be spaced apart from an upper part of the step of the cap main body, the content discharge guide comprising a discharge guide part having a liquid discharge port formed in a central region of the discharge guide part so as to be recessed concavely and a cylindrical discharge channel protruding from an upper part of a center of the discharge guide part for guiding a discharge of the liquid contents, the discharge guide part having an air discharge port disposed at an edge of the discharge guide part, through which air in the inverted compression receptacle can move to a lower side of the discharge guide part when the inverted compression receptacle is compressed, and having an air introduction port, through which external air is introduced into the inverted compression receptacle when the inverted compression receptacle is restored to an original state thereof;

a valve housing comprising a cylindrical coupling part fitted into an upper part of the content discharge guide so as to cover the upper part of the content discharge guide such that an air compartment, which communicates with the air discharge port and the air introduction port, is defined in the cylindrical coupling part, the cylindrical coupling part having a content suction port disposed in a central region of the cylindrical coupling part, the cylindrical coupling part being coaxially fitted into the discharge channel defined in the content discharge guide, a content check valve for selectively opening and closing the content suction port depending on whether the inverted compression receptacle is compressed, and a tube fitting port protruding from an upper surface of the valve housing so as to communicate with the air compartment;

an air tube having a lower end fitted into the tube fitting port of the valve housing and an upper end extending toward an upper part of the inverted compression receptacle, for allowing an upper space in the inverted compression receptacle 100, in which air remains, and the air compartment to communicate with each other therethrough;

an air check valve unit made of an elastic material, the air check valve unit comprising a ring-shaped partition wall having an upper end disposed in tight contact with a lower surface of the content discharge guide and a lower end disposed in tight contact with an upper part of the step of the cap main body for defining an air and liquid mixing chamber in the foam discharge part, a first check valve part disposed inside the partition wall so as to extend upward toward a central part of the air check valve unit, an end of the first check valve part being disposed in elastically tight contact with the discharge guide part of the content discharge guide, the first check valve part being configured to allow the air in the inverted compression receptacle to move to the air and liquid mixing chamber through the air discharge port when the inverted compression receptacle is compressed, and a second check valve part disposed outside the partition wall so as to extend downward toward an outside of the air check valve unit, an end of the second check valve part being disposed in elastically tight contact with an outside of the step of the cap main body, the second check valve part being configured to close the air hole when the inverted compression receptacle is compressed and to open the air hole when the inverted compression receptacle is restored to the original state thereof such that external air can be introduced;

a filtration member fitted in the foam discharge part of the cap main body, the filtration member being formed in a shape of a cylinder having open upper and lower parts, the filtration member being provided at upper and lower surfaces thereof with filtration nets, the filtration member being configured to guide a discharge of foam formed as a result of the liquid contents being mixed with air in the air and liquid mixing chamber while homogenizing the foam; and an upward and downward movement cap comprising a cylindrical wall surface having an upper end coupled to the upward and downward movement guide wall of the cap main body so as to be movable upward and downward and a lower surface configured to cover a lower part of the cap main body, the lower surface being provided with a plurality of foam distribution holes, through which the foam that has passed through the filtration member is discharged to the outside in a distributed manner, the upward and downward movement cap having a cylindrical blocking wall disposed at a center of the lower surface of the upward and downward movement cap in a protruding manner for selectively opening and closing the foam discharge part according to an upward and downward manipulation of the upward and downward movement cap.

2. The foam generator according to claim 1, wherein the content check valve comprises:

a valve body disposed in the coupling part of the valve housing so as to be slidable vertically for opening and closing the content suction port, an upper end of the valve body being formed in a conical shape; and an elastic member for elastically supporting the valve body upward in the coupling part of the valve housing.

3. The foam generator according to claim 1, further comprising a massage member, wherein the massage member comprises:

a base fitted in a lower part of the upward and downward movement cap, the base being provided therein with a plurality of communication ports, which communicate with the respective foam distribution holes; and massage bristles provided at a lower surface of the base for uniformly applying foam discharged through the communication ports to a skin of a user.

4. The foam generator according to claim 1, wherein support shafts are formed inside the upward and downward movement guide wall in a protruding manner such that the support shafts are opposite to each other, and the upward and downward movement cap is provided at an outside of the wall surface thereof with spiral grooves for receiving the support shafts, the spiral grooves being formed so as to be opposite to each other over a predetermined region, the upward and downward movement cap being disposed so as to move upward or downward to regular positions of the upward and downward movement cap by rotating the upward and downward movement cap in a forward direction or a reverse direction, whereby when the upward and downward movement cap is moved maximally downward as a result of the rotation of the upward and downward movement cap in the forward direction, the cylindrical blocking wall opens the foam discharge part, and when the upward and downward movement cap is moved maximally upward as a result of the rotation of the upward and downward movement cap in the reverse direction, the cylindrical blocking wall closes the foam discharge part.

* * * * *